US006022280A

United States Patent [19]

Arenburg et al.

[11] Patent Number: 6,022,280

[45] Date of Patent: Feb. 8, 2000

[54] MULTIPLE PURPOSE GOLF TOOL

[76] Inventors: Jason Arenburg, 189 Union St. #26, Attleboro, Mass. 02703; Robert Arenburg, 100 N. Ave., North Attleboro, Mass. 02763

[21] Appl. No.: 09/143,629

[22] Filed: Aug. 28, 1998

[51] Int. Cl.[7] ..... A63B 57/00

[52] U.S. Cl. ..... 473/408; 473/286

[58] Field of Search ..... 473/408, 406, 473/285, 286, 282, 405; D21/793

[56] References Cited

U.S. PATENT DOCUMENTS

| | | | |
|---|---|---|---|
| 904,872 | 11/1908 | Hill . | |
| 3,415,518 | 12/1968 | Root . | |
| 3,447,171 | 6/1969 | Eyer . | |
| 3,620,426 | 11/1971 | Hatch . | |
| 3,774,913 | 11/1973 | Dien . | |
| 4,063,731 | 12/1977 | Kitay . | |
| 4,151,937 | 5/1979 | Jarosh et al. . | |
| 4,535,987 | 8/1985 | Dikoff . | |
| 4,627,621 | 12/1986 | Tate . | |
| 4,787,632 | 11/1988 | Nigrelli et al. . | |
| 4,960,239 | 10/1990 | Wait . | |
| 4,974,842 | 12/1990 | Widman . | |
| 5,054,777 | 10/1991 | Borden et al. . | |
| 5,116,046 | 5/1992 | Pace . | |
| 5,143,371 | 9/1992 | Strahan . | |
| 5,152,524 | 10/1992 | Brown . | |
| 5,226,647 | 7/1993 | Notarmuzi . | |
| 5,292,120 | 3/1994 | Pehoski et al. . | |
| 5,295,683 | 3/1994 | Tate . | |
| 5,305,999 | 4/1994 | Tate . | |
| 5,388,824 | 2/1995 | Reimers . | |
| 5,401,019 | 3/1995 | Wissman et al. . | |
| 5,562,553 | 10/1996 | Digerness et al. | 473/408 |
| 5,645,500 | 7/1997 | Borden . | |
| 5,706,831 | 1/1998 | Whitbeck . | |
| 5,759,120 | 6/1998 | Mathis et al. | 473/408 |
| 5,788,197 | 8/1998 | Tutela | 473/408 |

*Primary Examiner*—Steven Wong
*Attorney, Agent, or Firm*—Salter & Michaelson

[57] ABSTRACT

A multiple purpose golf tool includes a planar body portion having top and bottom ends. A pair of elongated leg members extend from the bottom end of the body portion for loosening sod on the greens of a golf course for repairing divots. A pair of reversely bent spaced shoulder members extend rearwardly from the top end of the body portion communicating with a solid plate portion in spaced generally parallel relation to the body portion. A fork shaped plate is hingedly attached to the terminal end of the solid plate portion and is movable between a closed clamping position wherein an edge thereof bears against the body portion for use as a money clip, and an open position wherein the fork shaped plate extends away from the body portion for use as a golf shoe cleat tightener.

6 Claims, 4 Drawing Sheets

MULTIPLE PURPOSE GOLF TOOL

BACKGROUND AND SUMMARY OF INVENTION

This invention relates generally to golfing paraphernalia, and more particularly to a multi-purpose golf tool which includes a divot fixer, cleat-tightener, club rest or cigar/cigarette rest, ball marker, and hinged money clip in a single golf tool. The device is compact in size so that it can easily and comfortably be carried in the pocket of the user.

The game of golf is a sporting activity that has immensely grown in popularity over the past few decades. For some, the game is a type of addiction which provides relaxation, social activity, and even a small amount of exercise. In other words, for the avid golfer, the game of golf is a way of life. Many avid golfers are consistently looking for newly designed clubs, bags, and other accessories which may be helpful for improving their golf game.

The instant invention provides for a unitary golf tool which performs several functions that usually necessitate a plurality of different tools. Specifically, one of the more unique features associated with the unitary golf tool of the instant invention is its combination hinged money clip and cleat tightener device. The combination includes a forked plate member which is hingedly connected to shoulder support means at the rear portion of the device. The forked plate member is movable between a money clamping position wherein the plate is biased against the body of the tool, and a cleat tightening position wherein the plate extends away from the body of the tool. At the terminal forked ends of the plate member are a pair of dimples which are adapted to be inserted into corresponding tightening holes in the base of the shoe cleat for performing the cleat tightening function. It is important to understand that in order for the tool to be utilized as a cleat tightening device, the plate member must be swung to the outwardly extending horizontally oriented position, after removing any money clamped therebetween, at which point the tool is rotated in either a clockwise or counter clockwise direction depending on whether the user desires to tighten or loosen the selected spike or cleat.

The closest prior art of which the inventors are aware are Tate U.S. Pat. Nos. 4,627,621; 5,295,683; and 5,305,999. The '621 patent discloses a golf accessory provided with a divot tool and a clip. The clip may be used for attachment of the accessory to various portions of the user's clothing or golf bag. The clip may also be used as a money clip. The device further includes means for checking the spherical shape of a golf ball, detecting defects in the club face of a golf club, and a stand support for supporting the handle of a golf club. The '683 and '999 patents disclose similar golf accessories, each of which has a ball marker releasably attached thereto by magnetic means.

The instant invention is directed to a multiple purpose golf tool comprising a pair of elongated leg members depending downwardly from a generally round body portion of the device. The elongated leg members are operable for loosening sod on the greens of a golf course for fixing divots or indentations resulting from the landing of airborne golf balls on the greens of the golf course. The front side of the rounded body portion of the golf tool has magnetic ball marker means releasably secured thereto for marking placement of a golf ball on the greens of a golf course. The front side of the rounded body may further include an ornamental motif etched or otherwise applied around the outer perimeter thereof. A pair of spaced shoulder members extend rearwardly from the top edge of the body portion. The top edge of the body portion is curved inwardly providing concave support means for the placement of a cigar or golf club handle to prevent same from coming into contact with the turf of the golf course. The shoulder members are reversely bent in a direction extending away from the front side of the body portion. A fork-shaped plate member is hingedly connected to the terminal end of the shoulder portion and is operable in combination as both a hinged money clip when in a downwardly extending closed position and a cleat tightener device when in an outwardly extending open position.

Accordingly, among the several objects of the instant invention are: the provision of a golf tool which performs several different useful functions in a single unitary golf tool; the provision of a golf tool which is compact in size so that it may be easily and comfortably carried in the user's pocket; the provision of a golf tool which is operable as a divot fixer; the provision of a golf tool which is operable as a club rest or cigar/cigarette rest; the provision of a golf tool which is operable as a ball marker; the provision of a golf tool which is operable as a hinged money clip; the provision of a tool that functions as a cleat tightening device; the provision of a golf tool that is neat and attractive in appearance; and the provision of a golf tool that is cost efficient and easy to manufacture.

Other objects, features, and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
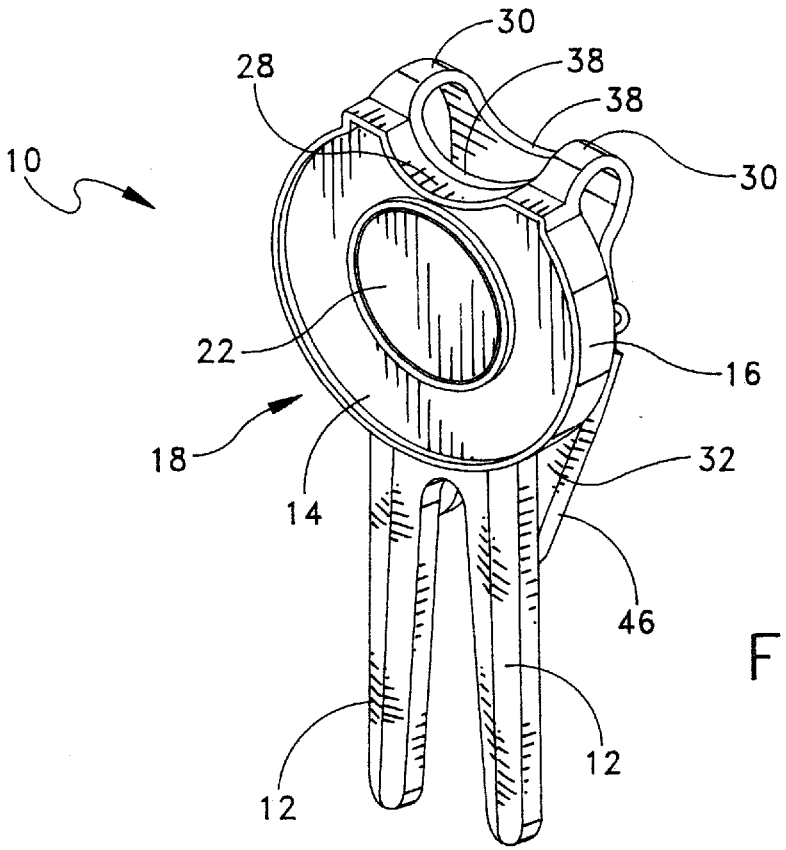
FIG. 1 is a perspective view showing the multi-purpose golf tool of the instant invention.

Referring now to the drawings, and more particularly to FIG. 1, the golf tool of the instant invention is shown and generally indicated at 10. As will hereinafter be more fully described, the instant invention provides for a single unitary golf tool which is capable of performing several functions which traditionally require the use of several different tools.

Figure 2:
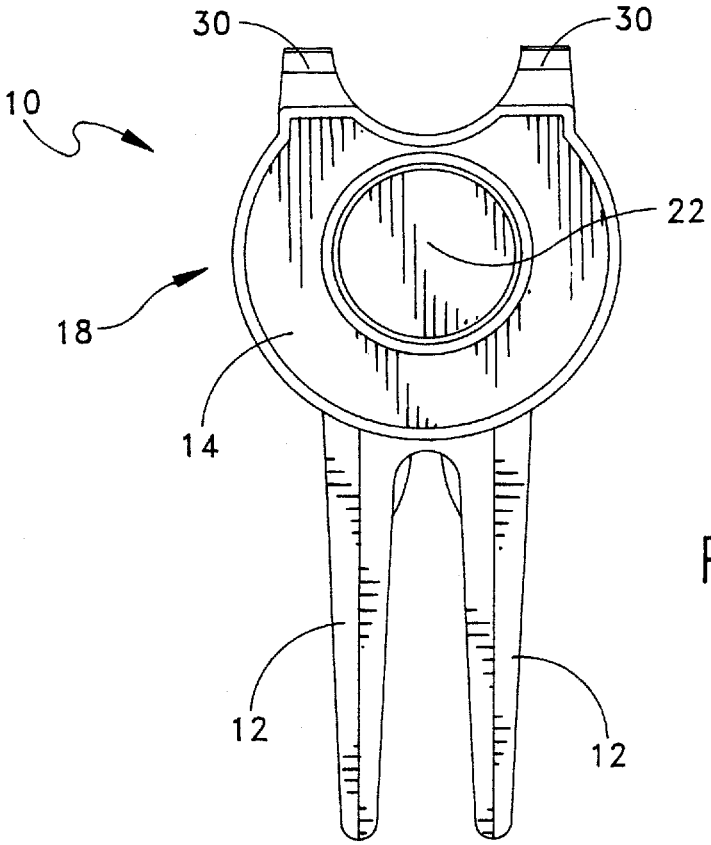
FIG. 2 is a front view thereof.

Referring to FIGS. 1–2, the golf tool of the instant invention 10 includes a pair of elongated leg members 12 which depend downwardly from a rounded body portion 14 of the device 10. The elongated leg members 12 are rounded at their bottom ends for penetration of the turf for fixing divots or indentations in a golf green putting surface. The top portion of the leg members 12 are integral with and extend downwardly from the peripheral edge 16 of the body portion 14. The golf tool 10 of the instant invention has a front side 18 and a rear side 20. The body portion 14 of the tool 10 has a circular ball marking plate 22 magnetically secured to the front side 18 thereof. Specifically, the ball marking plate 22 is seated in an annular recess 24 (see FIG.6) formed in the front side 18 of the annular body portion 14 of the device 10. A magnet 26 is secured within the annular recess 24 for magnetically receiving ball marking plate 22. As will be seen most clearly in FIG. 6, magnet 26 does not occupy the entire recess 24 but rather is cut away to leave a space 27 adjacent its bottom. This space enables the user to press the bottom portion of marker 22 inwardly, thus pivoting the upper portion of the marker outwardly for easy grasping and removal.

The outer perimeter of the front side 18 of the body 14 may include an ornamental motif or insignia, not shown in the drawings, which may be engraved therein or otherwise applied. The edge 16 of the body portion 14 at the top end of the tool 10 is curved inwardly to form a concave supporting surface 28 for placement of a cigar/cigarette or golf club handle to prevent same from coming into contact with the turf of the golf course. A pair of shoulders 30 extend rearwardly from the side edge 16 of the annular body 14 at the top end thereof and then downwardly into communication with solid portion 31. A fork-shaped plate member 32 is hingedly connected to the terminal end of portion 31 and extends downwardly therefrom. The terminal forked ends of the hinged plate member 32 include a pair of spaced dimples 34 for insertion within corresponding holes at the base of the cleat spike for removing or replacing cleats at the bottom sole of a golf shoe. The forked plate member 32 must be swung to a fully horizontal and open position with respect to the body of the tool 10 to be utilized as a cleat tightening device, as shown most clearly in FIG. 5.

Figure 3:
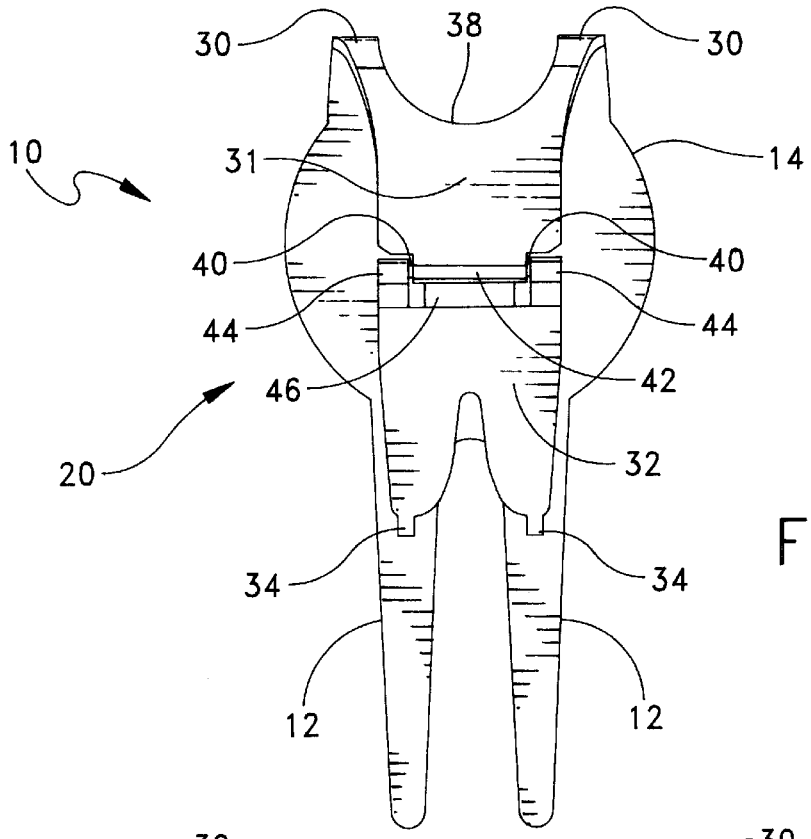
FIG. 3 is a rear view thereof.
Figure 4:
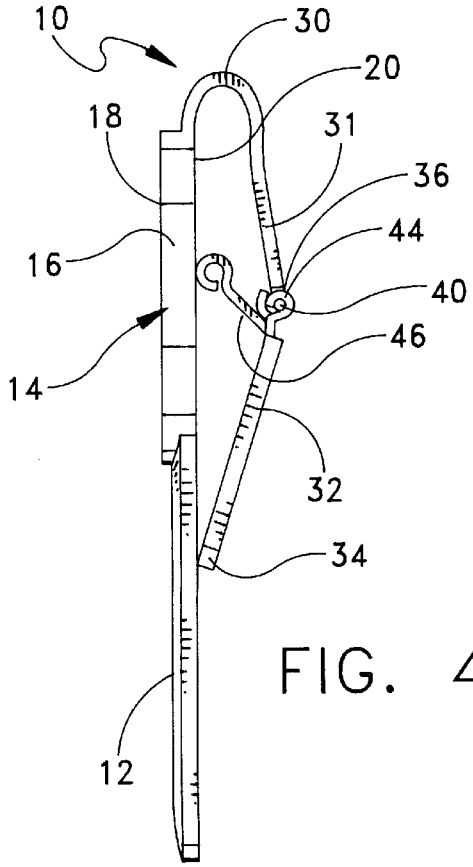
FIG. 4 is a side view thereof showing the hinged money clip in a closed position.
Figure 5:
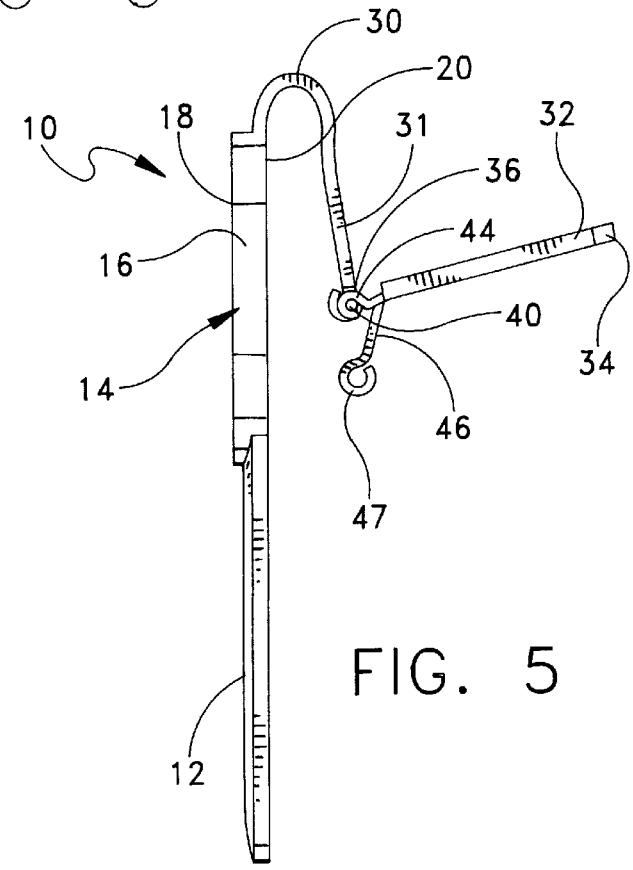
FIG. 5 is a side view thereof showing the hinged money clip in an open position.

Referring now to FIGS. 3–5, the combination hinged money clip and cleat tightening features of the tool 10 are more clearly depicted. Referring first to FIG. 3, the rear portion 20 of the golf tool 10 is depicted showing shoulders 30 merging with portion 31 at the rear side 20 of the tool 10, and the forked tab plate 32 is hingedly connected to the terminal end 36 of portion 31. The top edges 38 that extend between the shoulders 30 form correspondingly concave supporting surfaces aligned with the concave top edge 28 of the annular body 14 for supporting the placement of a cigar/cigarette or golf club handle to prevent same from coming into contact with the turf of the golf course. Actually, edges 28 and 38 combine to form a support that is capable of maintaining cigars and cigarettes in a horizontal position such that no portion thereof touches the ground, which may contain pesticides, herbicides, etc.

At the terminal end 36 of the solid portion 31, is a toggle-like hinge mechanism for movement of the forked plate 32 between a closed and opened position with respect to the body 14 of the tool 10. Specifically, the hinge mechanism includes a hinge pin 40 extending through hinge barrel 42 integrally formed at the terminal end of portion 36 and spaced barrels 44 integrally formed at the outer ends of the forked plate 32. A tongue 46 having a curled end 47 extends integrally and rearwardly from the upper central portion of plate 32 at an obtuse angle thereto (FIG. 5). Tongue 46 is of sufficient length so that when plate 32 is swung from its open position (FIG. 5) to its closed position (FIG. 4), curled end 47 frictionally slides against rear side 20 until plate 32 reaches its completely closed position. Thus the tongue 46 resiliently biases plate 32 to its closed position, so that when the device is used as a money clip, dollar bills 48 are resiliently clamped between rear side 20 and curled end 47 and also the lower end of plate 32 (see FIG. 7). Although the hinge mechanism just described has been found to be effective, it will be understood that other forms of spring loaded pivot means may be used to pivotally interconnect plate 32 and portion 31.

Referring now to FIGS. 4–5, the forked clamping plate 32 is depicted in both the vertically oriented and horizontally oriented positions with respect to the body of the tool 10 more clearly depicting the operation of the hinge mechanism and combination hinged money clip/cleat tightening plate 32. Referring to FIG. 4, the forked clamping plate is in the vertically oriented position wherein the tool 10 may be operable as a hinged money clip. As shown in the drawing, the terminal forked ends of the clamping plate 32 are in contact with the top ends of leg members 12 and the tongue 46 is in engagement with the rear surface 20 of the annular body 14. Specifically, the tongue 46 is operable for snap-locking the forked plate 32 to the closed position wherein the tongue 46 rides upwardly against the rear surface 20 of the body 14 when plate 32 is moved to the closed position. Referring now to FIG. 5, plate 32 is oriented in the horizontal position wherein the tool 10 may be operable as a cleat tightening device. In this position, tongue 46 is disengaged from the rear surface 20 of the annular body 14 and the terminal forked ends of plate 32 are in an outwardly extending operable position for cleat tightening.

Figure 6:
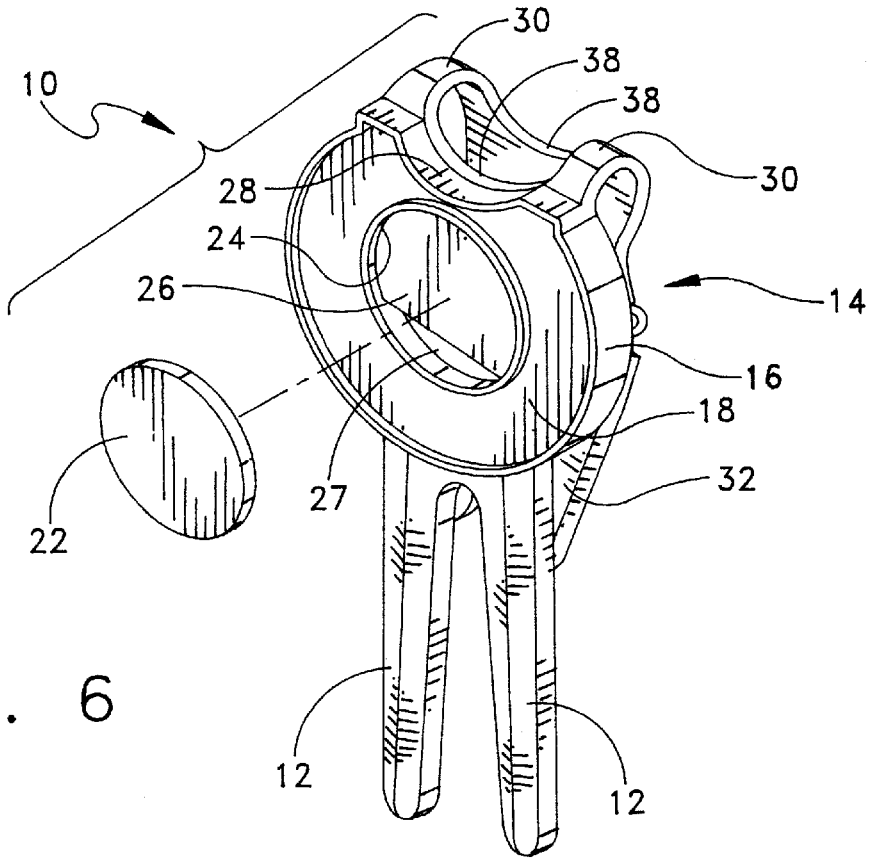
FIG. 6 is an exploded perspective view showing the ball marker removed from the center magnetic portion of the tool.

Referring now to FIG. 6, the annular ball marking plate 22 is shown unseated from its magnetically secured position in recess 24 on the front side 18 of the annular body 14 of the tool 10. As previously discussed, recess 27 is located below magnet 26 so as to provide a space below the lower edge of magnet 26 whereby the user can depress the corresponding bottom edge of the ball marker 22, when it is in its seated position, with his or her thumb which in turn will force the top end of the marker 22 outwardly from its seat enabling the user to grasp the ball marker and remove it from recess 24 at the front side 18 of the annular body portion 14.

Figure 7:
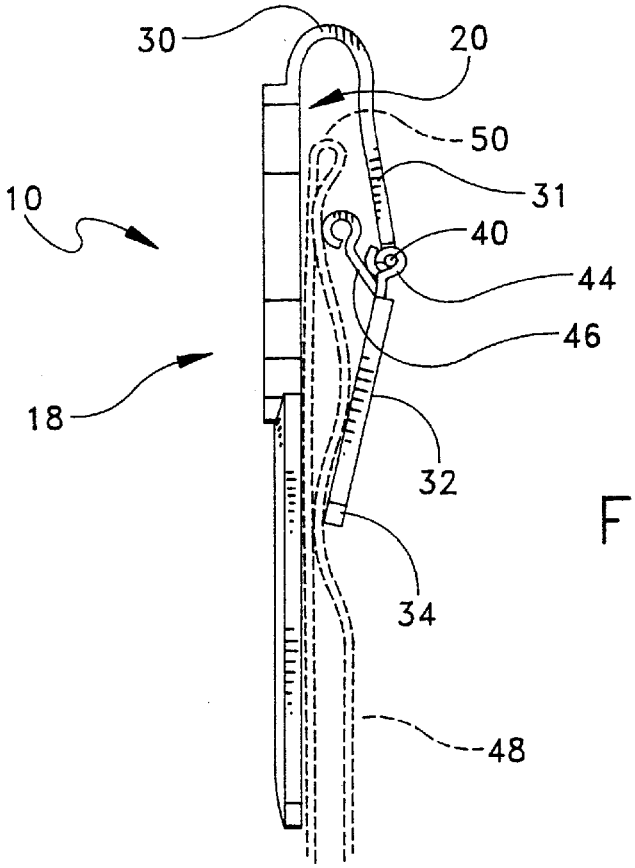
FIG. 7 is a side view showing money received within the hinged clamping portion of the tool.

Referring now to FIG. 7, the forked clamping plate 32 is depicted in the vertically oriented closed position wherein the tool 10 is operable as a hinged money clip. In the drawing, a stack of bills 48 are depicted clamped between the body portion of the device 10. In this position, the bills 48 are secured within the tool 10 at essentially two securing points. First, the curled end 47 of tongue 46 releasably secures the money 48 against the rear surface 20 of the body 14, and second, the forked terminal end of plate 32 releasably secures a portion of the stacked money 48 against the top portion of leg members 12. As shown in the drawing, the fold line 50 of money 48 must be received over the top of tongue 46 in order to securely maintain the money 48 in its clamped position. It should be noted, that increasing thickness associated with larger stacks of bills 48 may require bending shoulders 30 outwardly in order to accomodate the larger stack of bills, but the closing or clamping action of tongue 46 remains substantially the same. The shoulders 30 may then have to be bent back inwardly to effectively accomodate and clamp smaller stacks of bills.

Figure 8:
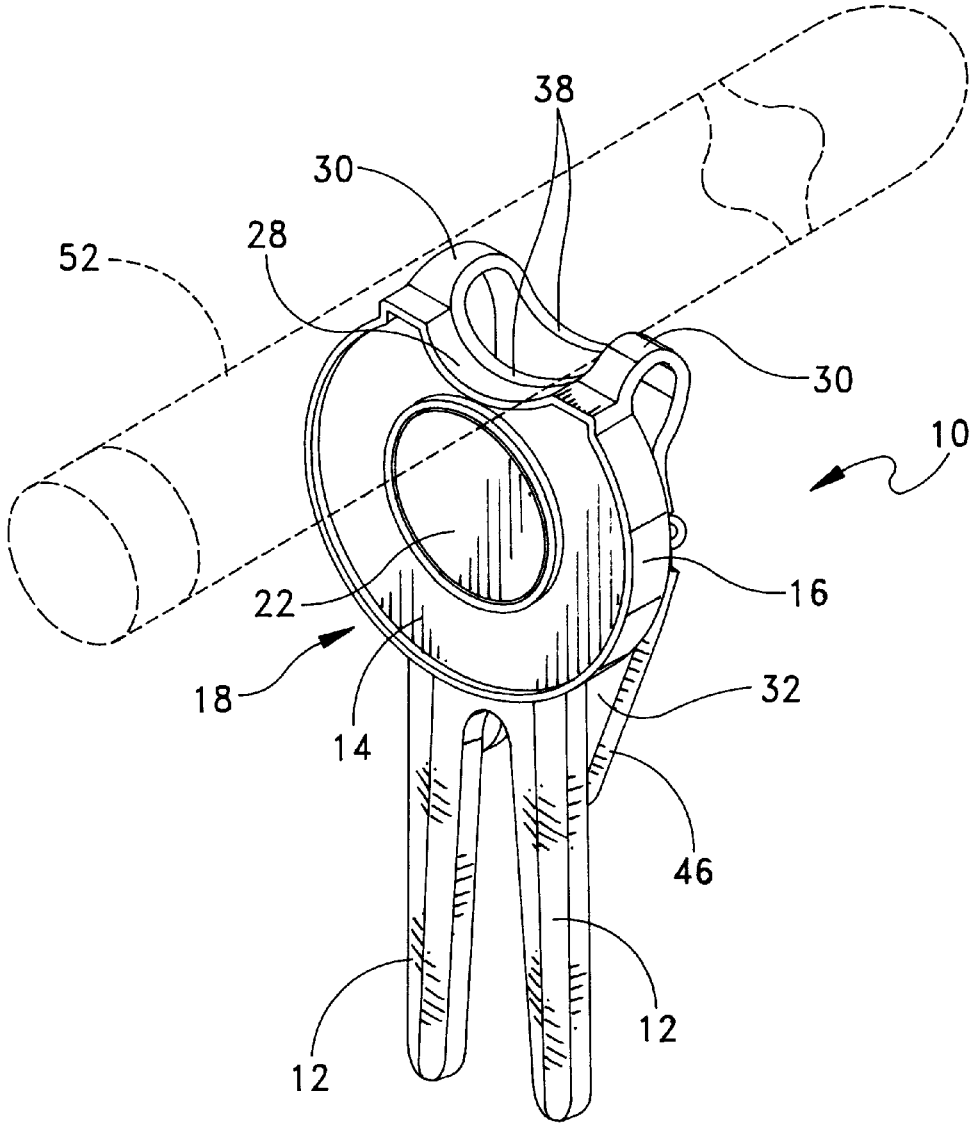
FIG. 8 is a perspective view showing a cigar received within support means located at the top portion of the tool.

Referring now to FIG. 8, the golf tool of the instant invention 10 is shown supporting a cigar 52 thus preventing same from coming into contact with the turf of the golf course. It should be understood that concave supporting means 28 are also operable for supporting a golf club handle and preventing same from coming into contact with a wet turf area on the golf course. It is important to understand that in order for the tool 10 to be used as a support rest, the downwardly extending legs 12 of the tool 10 must first be inserted into the turf area so that the concave supporting surface 28 is securely positioned above the ground.

It can therefore be seen that the instant invention provides for a unitary golf tool which effectively performs a plurality of different functions associated with the game of golf. The tool includes a uniquely designed combination hinged money clip and cleat tightening device. Specifically, a fork shaped plate member is hingedly connected to the rear side of the tool and movable between open and closed positions for performing both the money clip and the cleat tightening functions. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A multiple purpose golf tool comprising:

a substantially planar body portion having top and bottom ends;

a pair of elongated leg members extending from the bottom end of said body portion, said leg members operable for loosening sod on the greens of a golf course for repairing divots;

a pair of reversely bent spaced shoulder members extending rearwardly from the top end of said body portion communicating with a solid plate portion in spaced generally parallel relation to said body portion;

a fork shaped plate hingedly attached to the terminal end of said solid plate portion, said fork shaped plate being movable between a closed clamping position wherein an edge thereof bears against said body portion for use as a money clip, and an open position wherein said fork shaped plate extends away from said body portion for use as a golf shoe cleat tightener; and means for biasing said fork shaped plate to its said closed position.

2. The golf tool of claim 1, wherein said biasing means comprises an integral tongue extending from said fork shaped plate toward said body portion, whereby when said fork shaped plate is pressed towards its closed position, said tongue engages said body portion and slides therealong to an over-the-enter position to resiliently snap-close said fork shaped plate.

3. The golf tool of claim 2, wherein said tongue has a curled end to facilitate sliding movement thereof against said body portion.

4. The golf tool of claim 1 further comprising a circular recess on the front surface of said body portion;

a magnet mounted in said recess;

a circular disc for use as a ball marker snugly received within said recess and releasably retained therein by said magnet.

5. The golf tool of claim 4, said magnet having a cut-away portion at an edge thereof to provide a space beneath said disc, whereby pressure on said disc at the location of said space causes the disc to pivot outwardly to facilitate grasping and removal thereof.

6. The golf tool of claim 1, wherein the top portion of said body portion has a concave curved edge, and the top of said solid plate portion has a corresponding aligned curved edge, whereby when said leg members are inserted into the ground, said aligned curved edges form a support for receiving the handle of a golf club or a cigarette or cigar to support same above the ground.

* * * * *